US010343840B2

(12) United States Patent
McDuffe

(10) Patent No.: US 10,343,840 B2
(45) Date of Patent: Jul. 9, 2019

(54) SUMP PIT HAVING DISASSEMBLABLE UPPER AND LOWER TANK PORTIONS

(71) Applicant: William McDuffe, Headingley (CA)

(72) Inventor: William McDuffe, Headingley (CA)

( * ) Notice: Subject to any disclaimer, the term of this patent is extended or adjusted under 35 U.S.C. 154(b) by 45 days.

(21) Appl. No.: 15/645,165

(22) Filed: Jul. 10, 2017

(65) Prior Publication Data

US 2019/0009980 A1 Jan. 10, 2019

(51) Int. Cl.

| | |
|---|---|
| ***B65D 88/76*** | (2006.01) |
| ***B65D 90/02*** | (2019.01) |
| ***B65D 90/00*** | (2006.01) |
| ***E03F 5/00*** | (2006.01) |

(52) U.S. Cl.

CPC ..... *B65D 88/76* (2013.01); *B65D 90/0006* (2013.01); *B65D 90/024* (2013.01); *E03F 5/00* (2013.01)

(58) Field of Classification Search

CPC ..... B65D 88/00–76; B65D 90/00–024
USPC ..... 220/4.01–8, 4.21
See application file for complete search history.

(56) References Cited

U.S. PATENT DOCUMENTS 3,782,602 A * 1/1974 Page ..... B65D 21/0219 206/509
4,341,091 A * 7/1982 Minter ..... A01K 63/02 62/372
4,991,613 A * 2/1991 Kaminski ..... B65D 90/24 137/1
5,131,708 A * 7/1992 Denzin ..... A47J 39/02 16/429
5,727,901 A * 3/1998 Rennie ..... E02D 31/02 405/36
6,123,216 A * 9/2000 Yokocho ..... F02B 63/00 220/4.14
6,305,410 B1 * 10/2001 Cook ..... E03F 5/22 137/363
6,557,720 B2 * 5/2003 Tosdale ..... A47J 27/12 206/518
7,810,666 B2 * 10/2010 Borchert ..... B32B 27/00 220/4.13
8,528,764 B2 * 9/2013 Chapple ..... B65D 11/04 215/388
2008/0156800 A1 * 7/2008 Mougenot ..... B60K 15/0403 220/86.3
2013/0220999 A1 * 8/2013 Usui ..... B60K 15/03177 220/4.14

(Continued)

*Primary Examiner* — Kareen K Thomas
(74) *Attorney, Agent, or Firm* — Adrian D. Baltison; Ade & Company Inc.; Ryan W. Dupuis

(57) ABSTRACT

A collection tank for mounting under a floor of a building for collecting water from an area under the floor comprises upper and lower tank portions removably securable by rotatable mating of tabs in cavities. Additionally, a pump platform of the tank is formed by a plurality of ridges which form therebetween a channel so that the water is collectable in the tank between the ridges. Furthermore, the upper and lower tank portions are separable, and a width of the top of the upper tank portion is smaller than a width of the open top of the lower tank portion such that the upper tank portion can be received in the lower tank portion in an inverted orientation, in which the collection tank is inoperable for collecting the water, so as to decrease a height of the collection tank.

15 Claims, 12 Drawing Sheets

(56) References Cited

U.S. PATENT DOCUMENTS

| | | | | |
|---|---|---|---|---|
| 2016/0016347 | A1* | 1/2016 | Kimura | B29C 69/02<br>220/4.13 |
| 2016/0039582 | A1* | 2/2016 | Hui | A45D 34/00<br>206/457 |

* cited by examiner

SUMP PIT HAVING DISASSEMBLABLE UPPER AND LOWER TANK PORTIONS

FIELD OF THE INVENTION

The present invention relates to collection tanks placed under a floor of a building to collect water from an area under the floor, and in which a pump is typically disposed for transferring the water from inside the tank to a location beyond a footprint of the building. Such collection tanks are often termed in industry as sump pits.

BACKGROUND

Commonly, sump pits comprise a unitary construction where a lower tank portion, which defines a substantially imperforate base of the sump pit so as to contain the water collected therein, and an upper tank portion, which is perforated so that water can flow through its wall and into the tank, and which is conventionally open at its top, are formed unitarily thereby resulting in a fairly bulky and at times large apparatus for locating in a sump cavity beneath location of the floor during installation of the sump pit. Furthermore, the bulkiness and large size may not aid shipping of multiple such units together, whereby the units take up more space.

Additionally, a conventional sump pit is designed for only a single sump pump to operate therein.

SUMMARY OF THE INVENTION

According to an aspect of the invention there is provided a collection tank for mounting under a floor of a building for collecting water from an area under the floor comprising:

a lower tank portion defining a base of the collection tank having a bottom wall for resting on a support surface and an outer wall upstanding from the bottom wall to define an open top of the lower tank portion;

an upper tank portion for standing upwardly from the open top in a working position of the tank having an outer wall extending upwardly from a bottom to a top of the upper tank portion;

the upper tank portion including at least one opening such that the water can flow into the collection tank;

the upper tank portion being removably securable to the lower tank portion in the working position by cooperation of a tab projecting outwardly from the outer wall of the lower tank portion and a cavity defined on an inside of the upper tank portion such that by rotation of the upper tank portion relative to the lower tank portion said tab and cavity are mated in a locked condition of the upper and lower tank portions.

This allows for the collection tank, often termed in industry as a sump pit, to be disassembled for ease of installation, such that one portion at a time may be brought into a cavity in which the tank is being installed. Additionally, disassembly may allow for reducing the space occupied by a plurality of like tanks during shipping.

Preferably the upper tank portion tapers in width from the bottom to the top such that the upper tank portion and another one of the like can be nested one in the other.

Preferably a width of the top of the upper tank portion is smaller than a width of the open top of the lower tank portion such that the upper tank portion can be received in the lower tank portion in an inverted orientation. In this manner, an overall height of the tank can be reduced for shipping.

Preferably the outer wall of the upper tank portion is frustoconical in shape so that the upper tank portion and another one of the like can be stacked in nested condition.

In an arrangement, the lower tank portion includes a rim defining a support surface on which a bottom surface of the upper tank portion is rested in the working position.

In an arrangement, the lower tank portion defines a ledge surface spaced below the tab such that a bottom edge of the upper tank portion is in contact with the ledge surface in the working position.

Preferably the cavity of the upper tank portion extends in a circumferential direction of the upper tank portion from a closed end to a throat which opens at the bottom of the upper tank portion such that the upper tank portion is positionable in the working position by alignment of the throat and tab.

In an arrangement, the cavity comprises a pair of neck portions terminating at closed ends that are spaced apart circumferentially of the upper tank portion and a throat communicating with the neck portions that is intermediate the closed ends such that the upper tank portion is rotatable in one of two opposite rotational directions for mating the tab and cavity in the locked condition.

Preferably the lower tank portion includes at an inside of the bottom wall a pump platform.

In an arrangement, the pump platform is defined by a plurality of ridges raised above the bottom wall forming therebetween a channel so that the water is collectable in the lower tank portion between the ridges.

Thus, more than one pump for pumping the water out of the tank may be located on a portion of the pump platform, which is defined by one or more ridges, surroundable by water.

According to another aspect of the invention there is provided a collection tank for mounting under a floor of a building for collecting water from an area under the floor comprising:

a lower tank portion defining a base of the collection tank having a bottom wall for resting on a support surface and an outer wall upstanding from the bottom wall to define an open top of the lower tank portion;

an upper tank portion having an outer wall extending upwardly from a bottom connected to the lower tank portion to a top of the upper tank portion;

the upper tank portion including at least one opening such that the water can flow into the collection tank;

a pump platform defined by a plurality of ridges raised above the bottom wall forming therebetween a channel so that the water is collectable in the lower tank portion between the ridges.

In an arrangement, at least some of the ridges are arranged in an array following a shape of the periphery of the bottom wall.

At least some of the ridges may be arranged in a circular array.

In an arrangement, the plurality of ridges includes a central ridge and a plurality of peripheral ridges each extending parallel to a portion of a periphery of the central ridge.

According to a further aspect of the invention there is a provided a collection tank for mounting under a floor of a building for collecting water from an area under the floor comprising:

a lower tank portion defining a base of the collection tank having a bottom wall for resting on a support surface and an outer wall upstanding from the bottom wall to define an open top of the lower tank portion;

an upper tank portion having an outer wall extending upwardly from a bottom connected to the lower tank portion to a top of the upper tank portion;

the upper tank portion including at least one opening such that the water can flow into the collection tank;

wherein the lower and upper tank portions are separable from one another, and wherein a width of the top of the upper tank portion is smaller than a width of the open top of the lower tank portion such that the upper tank portion can be received in the lower tank portion in an inverted orientation, in which the collection tank is inoperable for collecting the water, so as to decrease a height of the collection tank.

Preferably the upper tank portion tapers in width from the bottom to the top.

The outer wall of the upper tank portion may be frustoconical in shape so that the upper tank portion and another one of the like can be stacked in nested condition.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
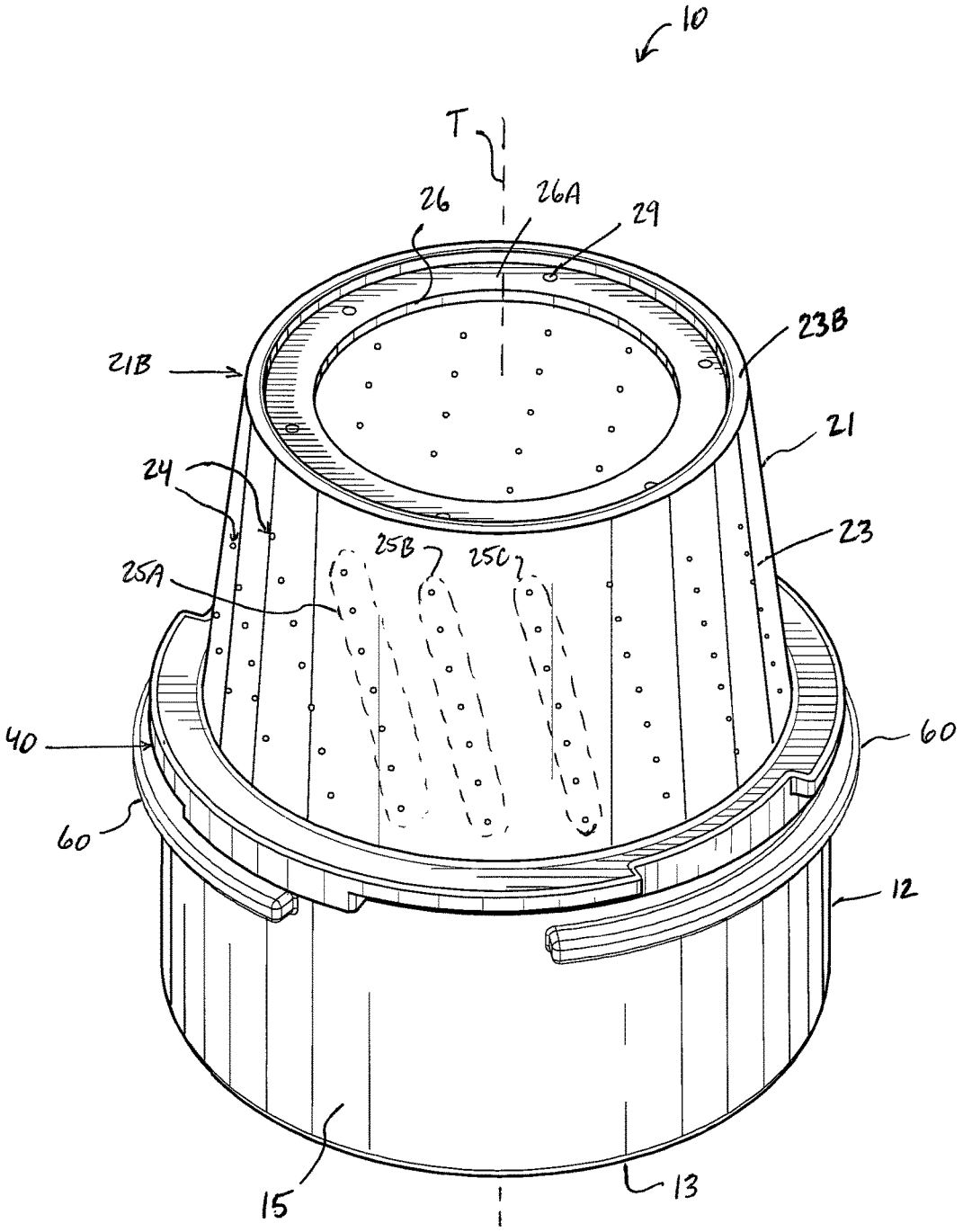
FIG. 1 is a perspective view of collection tank according to an embodiment of the present invention from the top thereof.
Figure 2:
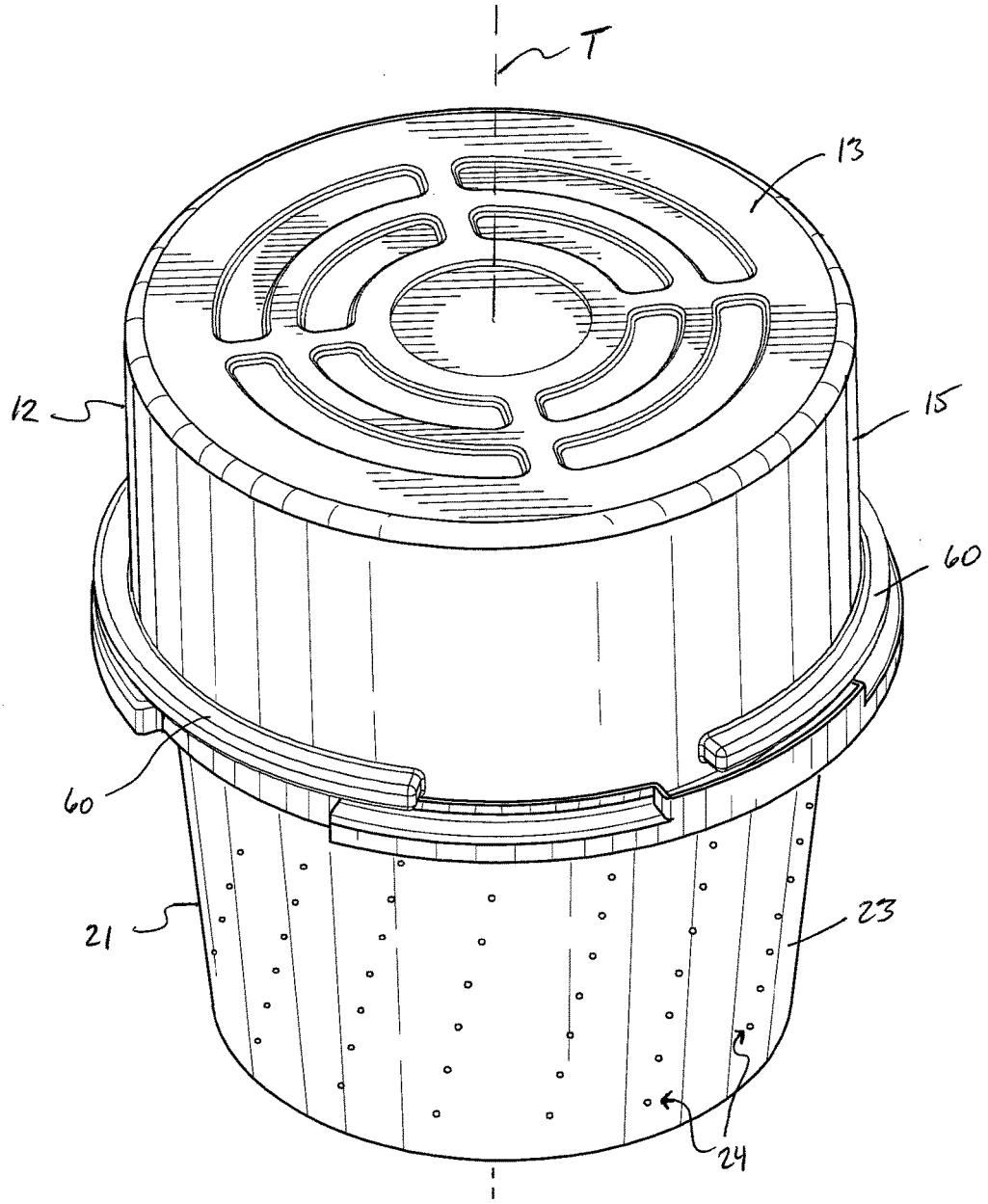
FIG. 2 is a perspective view of the collection tank of FIG. 1 from the bottom.
Figure 3:
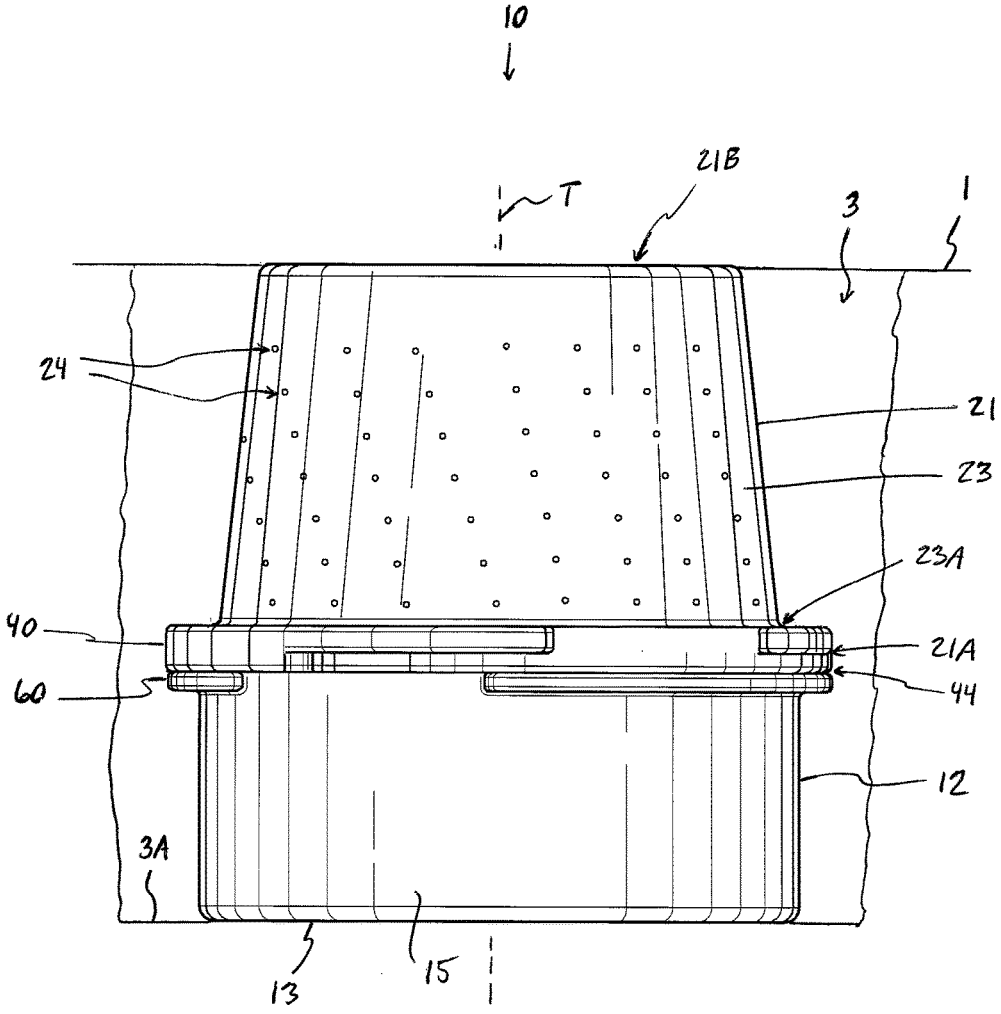
FIG. 3 is a front elevational view of the collection tank of FIG. 1.
Figure 4:
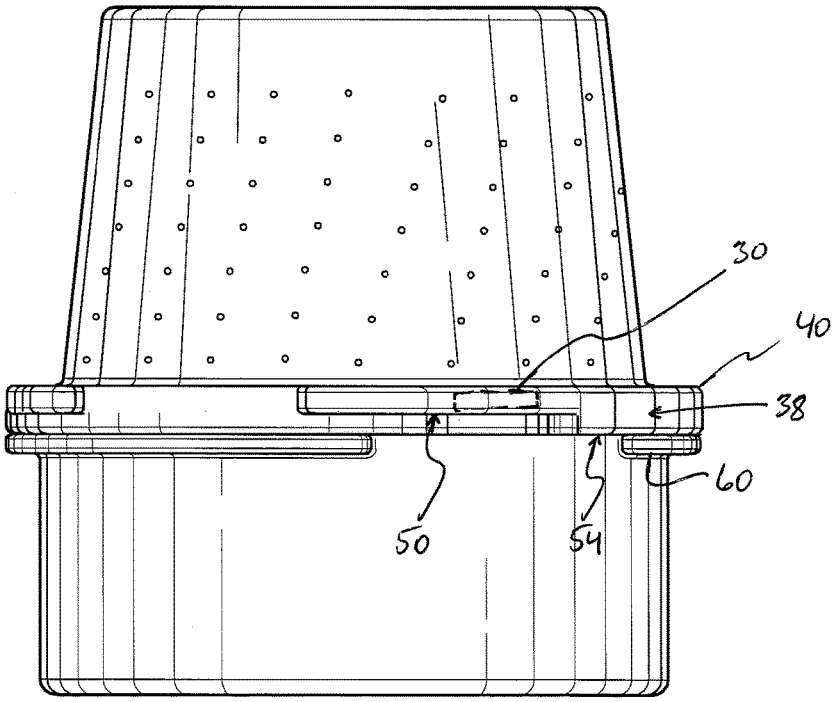
FIG. 4 is a side elevational view of the collection tank of FIG. 1.
Figure 5:
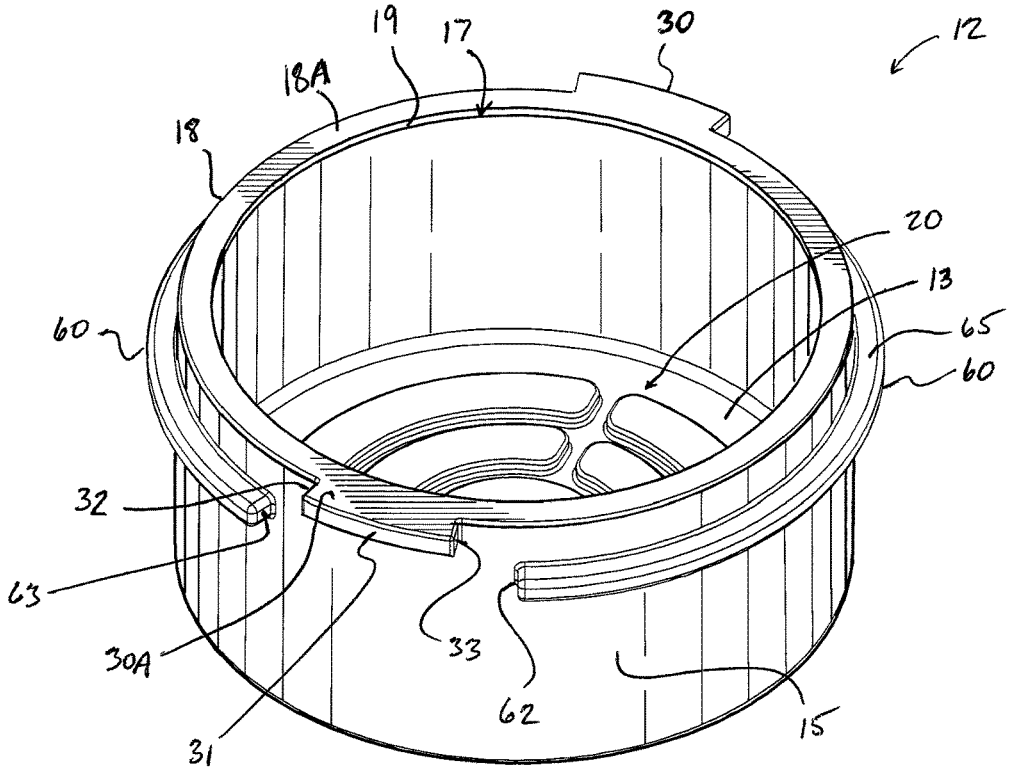
FIG. 5 is a perspective view of lower tank portion of the collection tank of FIG. 1 from the top thereof.
Figure 6:
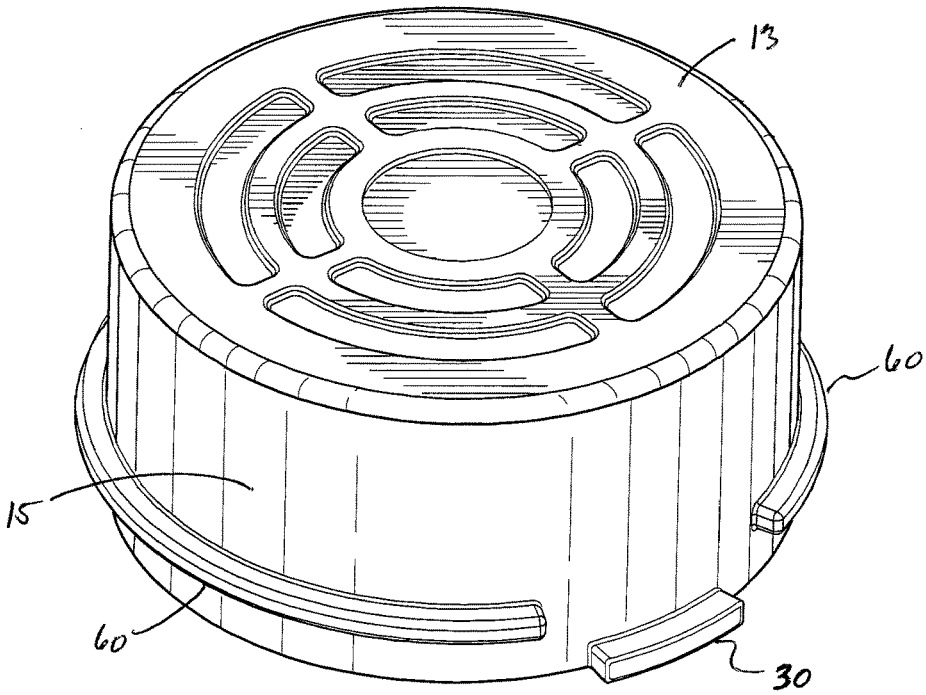
FIG. 6 is a perspective view of the lower tank portion of FIG. 5 from the bottom.

There is illustrated in the figures a collection tank 10 for mounting under a floor 1 (schematically shown) of a building, typically in a cavity 3 (schematically shown) formed beneath the floor, for collecting water from an area under the floor. In industry, such collection tanks are often termed 'sump pits'.

The collection tank 10 comprises an imperforate lower tank portion 12 defining a base of the collection tank, which is illustrated in isolation in FIGS. 5-10. The lower tank portion 12 includes a bottom wall 13 for resting on a support surface, such as a bottom 3A of the sump cavity, and a circular cylindrical outer wall 15 upstanding at 90 degrees to the bottom wall to define opposite thereto an open top 17 of the lower tank portion. The open top is delimited by an inner rim 18 which extends radially inwardly towards a center of the lower tank portion beyond the cylindrical outer wall 15 such that a diameter Di of the open top 17 from diametrically opposite locations on an inner peripheral edge 19 of the inner rim is smaller than an outside diameter Do of the bottom wall. Further, at an inside of the bottom wall 13 is a pump platform 20 for supporting a pump P1 or P2 (schematically shown) raised above the bottom wall so that the water which enters into the tank can collect below the pump P1 or P2.

Further to the lower tank portion, the collection tank or sump pit 10 includes an upper tank portion 21 for standing upwardly from the open top 17 of the lower tank portion 12 in a working position of the tank, with a bottom surface 22 of the upper tank portion resting on a support surface 18A defined at the top of the lower tank portion by the inner rim 18. The upper tank portion is illustrated in isolation in FIGS. 11-16. The upper tank portion 21 includes a frustoconical outer wall 23 extending upwardly from a bottom 21A connected to the lower tank portion 12 in the working position to a top 21B of the upper tank portion, which when the tank 10 is installed in the cavity 3 is to be located at or proximal to the floor 1. The outer wall of the upper tank portion 21 locates a plurality of relatively small openings 24 such that water can flow into the collection tank therethrough. These flow openings 24 are arranged in an array of several inclined columns, like that indicated at 25A, each which extends upwardly and towards one side of the outer wall such that the respective column traverse both a height and a portion of the circumference of the outer wall 23. The array of openings extends across a majority of a height of the frustoconical outer wall 15 and across a full circumference thereof such that the columns of openings such as 25A, 25B, 25C are spaced each from the next in a circumferential direction of the upper tank portion.

The top 21B of the upper tank portion is open, the opening therein being delimited by a support rim 26 extending radially inwardly from the frustoconical outer wall 15 at a position spaced below its top edge 23B so that the support rim is recessed slightly from the wall top edge 23B. The rim 26 carries a plurality of elongated receptacles 28, shown more clearly in FIG. 19, depending downwardly beneath the rim to closed terminuses and spaced circumferentially about the rim, with receptacle openings 29 in an upper surface 26A of the rim for receiving fasteners such as screws (not shown) to attach a cap or cover to close the otherwise open top 21B. Through the open top 21B of the upper tank portion there is typically passed piping from the pump P1 or P2 situated on the pump platform 20 to a location externally of the tank for transferring the water collected in the tank out of same.

As will be appreciated, the collection tank 10 can be disassembled into separated upper and lower tank portions, which may ease installation as one portion at a time may be brought into the cavity 3 and which may allow for reducing the space occupied by a plurality of like tanks during shipping.

Thus, when the upper tank portion 21 is positioned on the lower tank portion 12 in the working position, they may be removably secured by relative rotational movement of one tank portion to the other. Typically, as the lower tank portion 12 is mounted first in the cavity 3, the upper tank portion 21 is that which is rotated relative to the lower tank portion, which is substantially stationary at the bottom of the cavity, to a locked condition of the upper and lower tank portions in which they cannot be separated in a lifting direction generally parallel to an tank axis T which the outer walls 15, 23 encompass.

In order to facilitate locked interconnection of the lower tank portion 12 relative to the upper tank portion, there is provided a pair of locking tabs 30 located diametrically opposite one another at the top of the lower tank portion such that tops 30A of the tabs lie in a common horizontal plane with the support surface 18A defined by the inner rim 18.

Each locking tab 30 projects radially outwardly from the cylindrical outer wall 15 of the lower tank portion to a free end 31 which follows an arcuate path from one side 32 of the respective tab to the other 33, and in the illustrated embodiment this path follows the outer wall 15. As such, the respective tab 30 extends along a portion of the circumference of the outer wall 15.

Cooperating with the locking tabs on the lower tank portion 12 are a pair of diametrically opposite cavities 38 for mating with the tabs 30 that are formed in a bottom periphery of the upper tank portion 21. That is, at the bottom 21A of the upper tank portion of the illustrated embodiment, a locking rim 40 projects radially outwardly from the frustoconical outer wall 23 to define an outermost periphery of the upper tank portion. Thus, the locking rim 40 comprises an upper wall 42, an outer peripheral wall 43 depending downwardly from this upper wall to a bottom edge 44 of the locking rim spaced outwardly from a bottom 23A of the frustoconical wall, and in some areas of the rim 40 a lower wall 45 which is opposite the upper wall so as to form an enclosure closed at its bottom, as will be better appreciated shortly. The locking rim also includes an inner peripheral wall 46 depending from the lower wall 45 to the bottom edge 44, which is sized and shaped to follow the cylindrical outer wall 15 of the lower tank portion so as to locate the upper tank portion centrally thereon in the working position.

The cavities 38, which are open from an inside of the locking rim 40 facing radially inwardly as for example indicated at reference numeral 47, each comprise a pair of neck portions 49, 50 extending circumferentially of the upper tank portion from a closed end defined by an end wall 51 to on an open end 52 of the respective neck portion which is communicated with a throat 54 located intermediate the neck portions. The throat 54 extends downwardly from the open ends 52 of the neck portions and opens at the bottom of the upper tank portion so as to be in communication with an outside of the upper tank portion so that the tabs 30 can be received in the neck portions 49, 50 of the cavities in the working position.

In the illustrated embodiment, location of the bottom edge 44 relative to the bottom 23A of the frustoconical outer wall 23 is different for the different portions of the cavities, and thus at the throat 54 the bottom edge 44 is located the furthest away from the bottom 23A following a path parallel thereto, and at the neck portions 49, 50 the bottom edge 44 is located closer to the bottom 23A while still following a path parallel thereto. As such, the neck portions 49, 50 are defined by opposing upper and lower walls 42, 45, the outer peripheral wall 43, and the end wall 51 defining a closed terminus of the respective neck portion. Similarly, the throat 54 is defined by the upper wall 42 and the outer peripheral wall 43, which at the throat extends from the upper wall below the lower wall 45 to the bottom edge 44 so as to be open at the bottom. The throat includes side walls 55, 56 which extend radially between the outer and inner peripheral walls 43, 46 and meet the lower wall 45, generally in line with the open end of the respective neck portion 49, 50. The outer peripheral wall 43 follows a path parallel to the bottom 23A of the frustoconical wall so as to be uniformly spaced therefrom along the full length of the respective cavity from opposing end walls 51. Furthermore, the inner peripheral wall 46 follows a path parallel to the outer wall 15 of the lower tank portion, and spans between both the neck portions 49, 50 and the throats 54 of the opposite cavities 38. The inner peripheral wall 46 provides the bottom edge for locating the upper tank portion centrally of the lower tank portion, as the inner peripheral wall 46 overlap a top of the outer wall 15 of the lower tank portion in the working position. Furthermore, in the illustrated embodiment, the upper wall 42 spans a full circumference of the bottom 23A of the upper tank portion's outer wall 23.

Thus, in order to arrange the upper and lower tank portions in the working position, the throat 54 and the respective tab 30 are aligned. More specifically, the tabs and throats of the cavities are aligned angularly of the central tank axis T. As a typical installation involves lowering the upper tank portion 21 into the cavity 3 from outside the cavity, there are provided visual markings in the form of raised linear bumps 57 (schematically shown in FIG. 13, and in broken line in FIG. 14), located on the upper wall 42 of the locking rim. The bumps 47 which are located centrally of the throats 54 indicate centers of the throats from above, so that an installer can visually monitor position of the throats 54 as the upper tank portion is lowered into the cavity 3 and onto the lower tank portion already mounted therein.

Once in the working position, meaning that the bottom surface 22 defined by an underside of the locking rim's upper wall 42 is received on the supporting surface 18A of the lower tank portion's inner rim 18, possible only when the throats 54 and locking tabs 30 are aligned, the upper tank portion 21 may be rotated in one of two opposite rotational directions, R1 or R2, for mating the tabs and cavities in the locked condition. When the throat and tabs are misaligned, the upper tank portion 21 will not be seated on the lower tank portion 12 with the underside 22 of the upper wall in abutment with the inner rim's support surface 18A as the locking tabs 30 which project outwardly past the bottom edge 44 at the inner peripheral wall 46 thus engage the bottom edge 44 located further inwardly than the free end 31 of the respective tab.

Thus, to dispose the upper and lower tank portions in the working position, each locking tab 30 is passed through an opening in a bottom of the locking rim 40 formed by the respective throat 54 until the bottom surface 22 of the upper tank portion abuts the support surface 18A at the top of the lower tank portion, providing the working position of the collection tank 10. In the working position, the tab is aligned with the open ends 52 of the neck portions, but as long as the tab 30 remains in the opening defined by the throat 54—that is, in the illustrated embodiment, between the side walls 55, 56 of the throat—the upper and lower tank portions are in an unlocked condition in which the upper tank portion 21 can be freely separated from the lower tank portion 12 by lifting movement in a direction generally parallel to the tank axis T. Thus, to dispose the upper and lower tank portions in the locked condition, the upper tank portion 21 is rotated around the tank axis T relative to the lower tank portion, which acts to locate the locking tab 30 in one of the neck portions 49, 50 of the respective cavity so that the tab is angularly offset from the throat 54. In some of the figures showing the collection tank in the working position, the location of the respective locking tab 30 within the cavity 38 is indicated by the respective tab 30 represented in stippled lines. In the neck portions, the locking tab 30 is confined by the upper and lower walls 42, 45 so that the upper tank portion 21 remains fixed in relation to the lower tank portion along the tank axis T. The upper tank portion 21 remains free to be rotated, the limits of rotation being defined by the opposite end walls 51 of opposing neck portions of a common cavity 38. Relative rotation of the upper and lower tank portions angular misaligns or offsets the tab and throat so as to dispose the upper and lower tank portions in the locked condition.

Further to the tabs, on the lower tank portion 12 there is provided a pair of support ledges 60 projecting radially outwardly from the cylindrical outer wall 15 at a location below the locking tabs 30. Each support ledge 60 extends circumferentially of the lower tank portion's outer wall 15 at a location angularly offset from the tabs 30 such that the tabs and support ledges do not overlap circumferentially of the lower tank portion. That is, ends 62, 63 of the respective support ledge are spaced from ends of the tabs in a circumferential direction of the outer wall 15. Furthermore, the support ledges 60 each define a ledge surface 65 spaced below the respective tab 30 such that the bottom edge 44 of the upper tank portion's locking rim is guided on the ledge surface in rotation between the unlocked and locked conditions in the working position. In the illustrated embodiment, the support ledges 60 are wholly spaced below the tabs 30 such that the ledge surfaces 65 are spaced below bottoms of the locking tabs.

The upper and lower tank portions are sized so that in the disassembled state of the collection tank, orientation of the tank portions may be manipulated to reduce size for shipping. For instance, the frustoconical outer wall 23 of the upper tank portion is tapered in diametric width from the bottom 21A to the top 21B of the upper tank portion, so that the top is narrower which width is indicated at Wt than the bottom indicated at Wb and, as such, the upper tank portion 21 and another one of the like can be nested one in the other and thus they can be stacked in nested condition one on top of the other.

Figure 15:
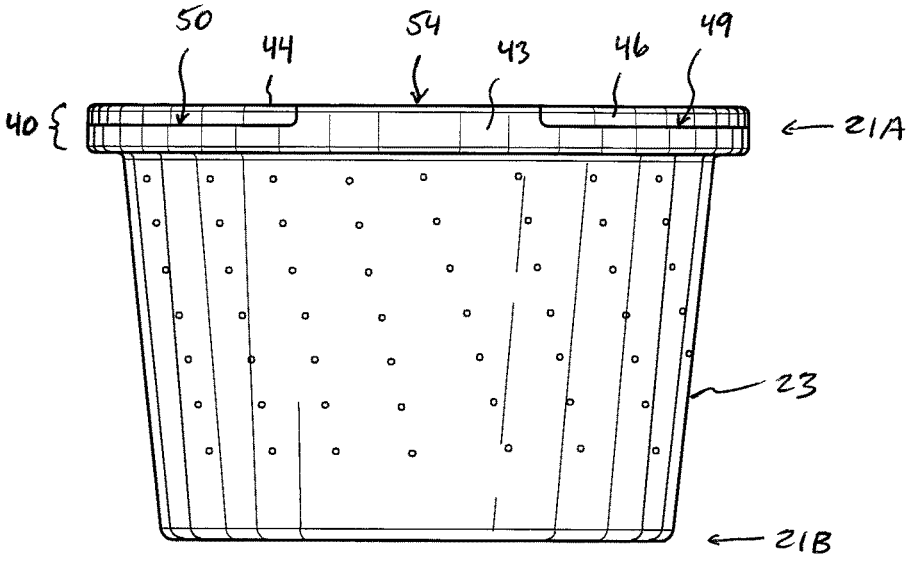
FIG. 15 is an elevational view of the upper tank portion of FIG. 11, shown in inverted orientation, from one side thereof.
Figure 16:
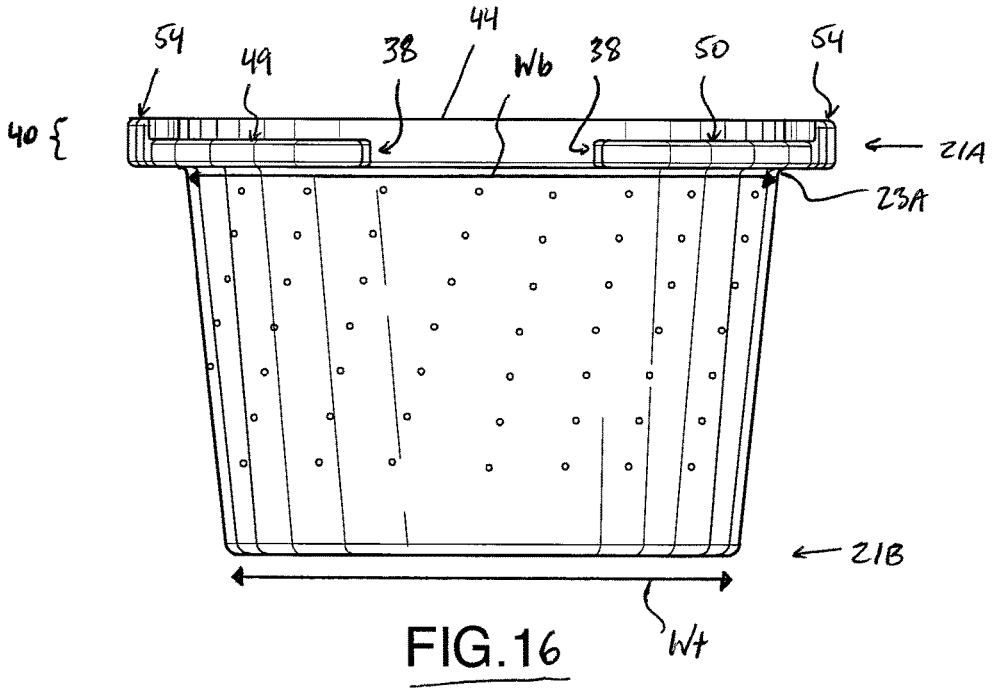
FIG. 16 is an elevational view of the upper tank portion of FIG. 11 in inverted orientation from another side 90 degrees from that in FIG. 15.
Figure 17:
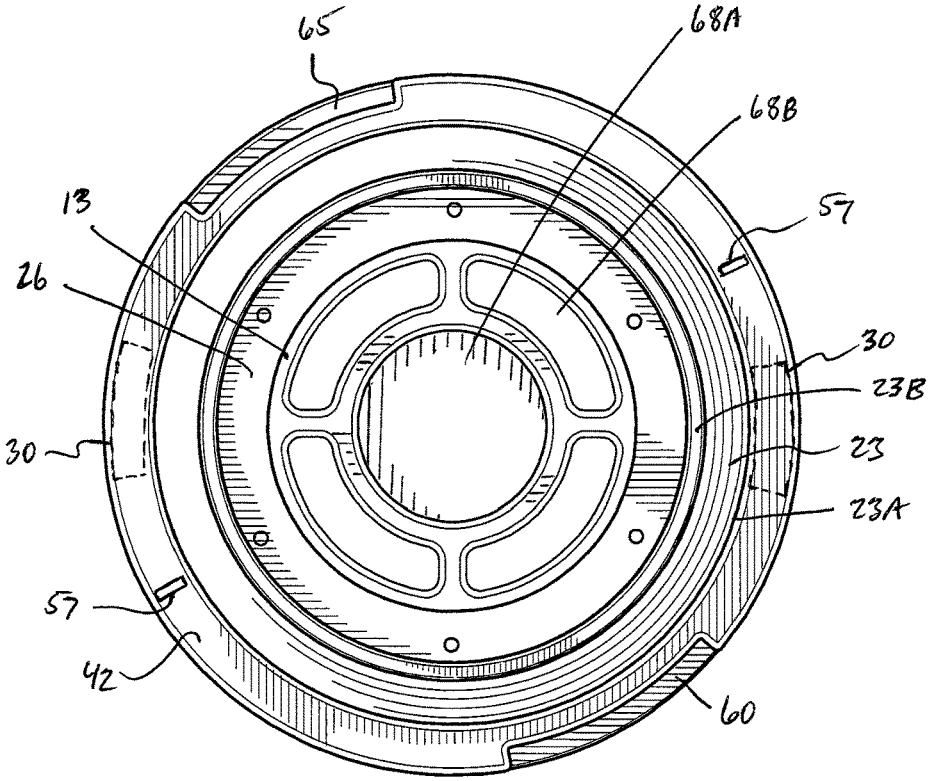
FIG. 17 is a top plan view of the collection tank of FIG. 1.
Figure 18:
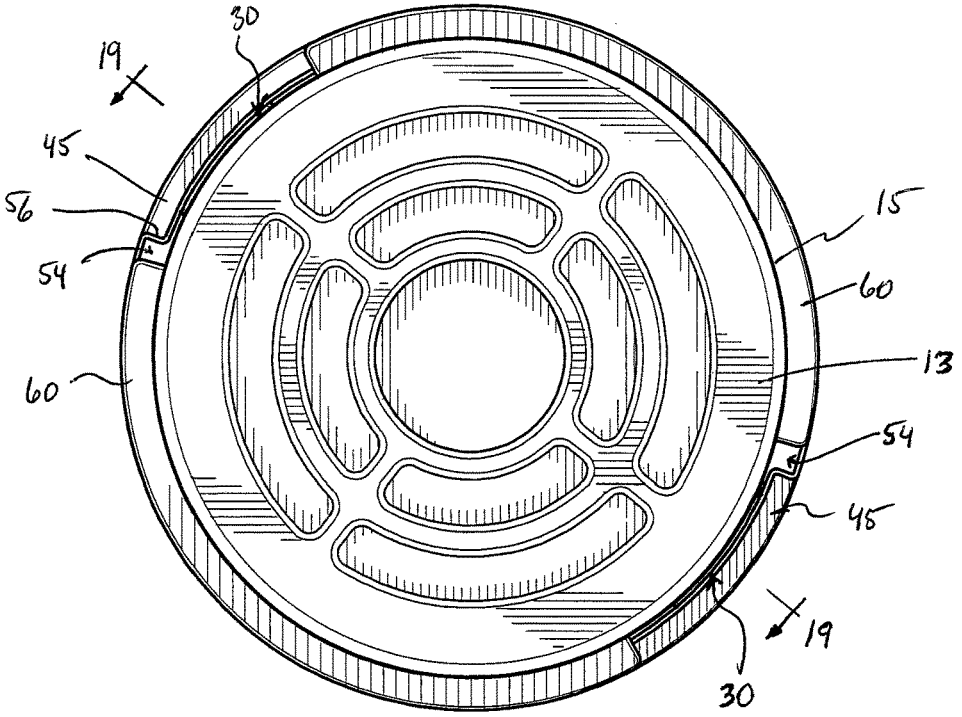
FIG. 18 is a bottom plan view of the collection tank of FIG. 1.

Furthermore, the diametric width Wt of the top 21B of the upper tank portion is smaller than the diametric width Di of the open top 17 of the lower tank portion 12 such that the upper tank portion 21 can be received in the lower tank portion in an inverted orientation, such as is shown in FIG. 15 or 16. In the illustrated embodiment, a portion of the height of the upper tank portion will still project beyond the open top 17 of the lower tank portion because the upper tank portion is taller than the lower tank portion, but, even so, an overall height of the tank can be reduced for shipping with the upper tank portion received in inverted orientation in the lower tank portion.

As previously mentioned, there is provided a pump platform 20, which in the illustrated embodiment is defined by a plurality of ridges 68A and 68B raised above an inside surface 13A of the lower tank portion's bottom wall 13, with planar top surfaces 70A and 70B lying in a common horizontal plane P spaced above the planar inside surface 13A of the bottom wall. The ridges comprise a central circular ridge 68A and a plurality of peripheral ridges 68B arranged in a circular array following the shape of the periphery of the bottom wall 13 and the outer wall 15. Each peripheral ridge 68B extends parallel to a periphery of the central ridge 68A. In the illustrated embodiment, there are a plurality of circular annuli or circular rings 73 and 74 of the peripheral ridges 68B each encompassing the central ridge 68A. The inner ring 73 encompasses the central ridge 68A only, while the outer ring 74 encompasses both the inner ring 73 and the central ridge 68A. Within each adjacent pair of ridges, whether both are of the peripheral type or one is a peripheral ridge and the other the central ridge, there is formed a channel between the adjacent ridges so that water (not shown) can collect in the lower tank portion therebetween. As such, more than one pump can be located upon a portion of the pump platform 20 which can be substantially surrounded by water for subsequent pumping out of the tank 10 to a location beyond the footprint of the building.

Figure 7:
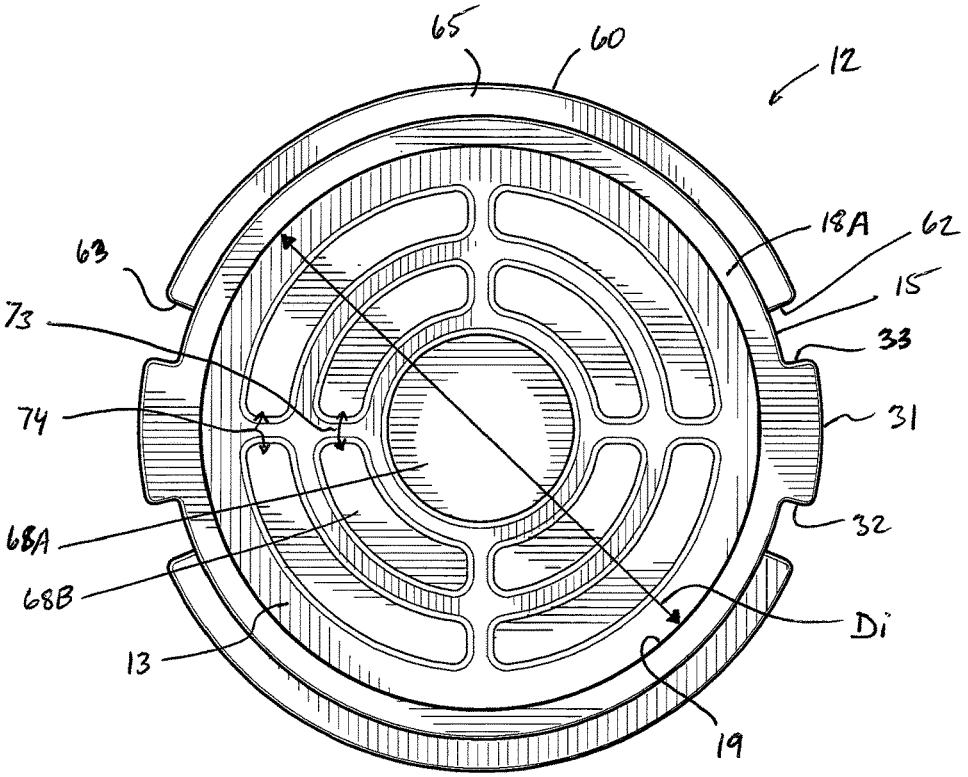
FIG. 7 is a top plan view of the lower tank portion of FIG. 5.
Figure 8:
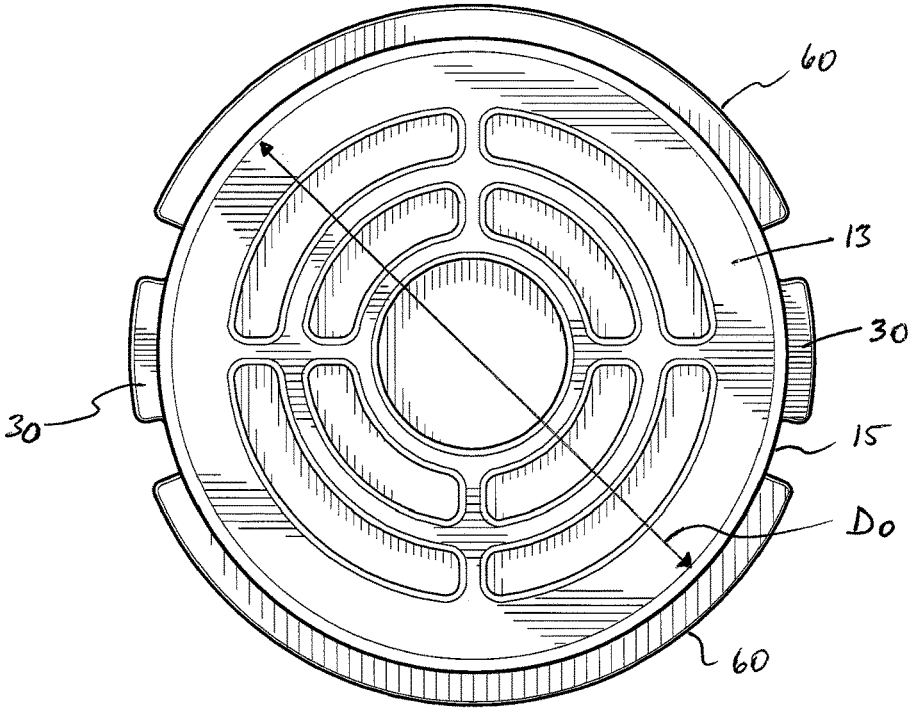
FIG. 8 is a bottom plan view of the lower tank portion of FIG. 5.
Figure 9:
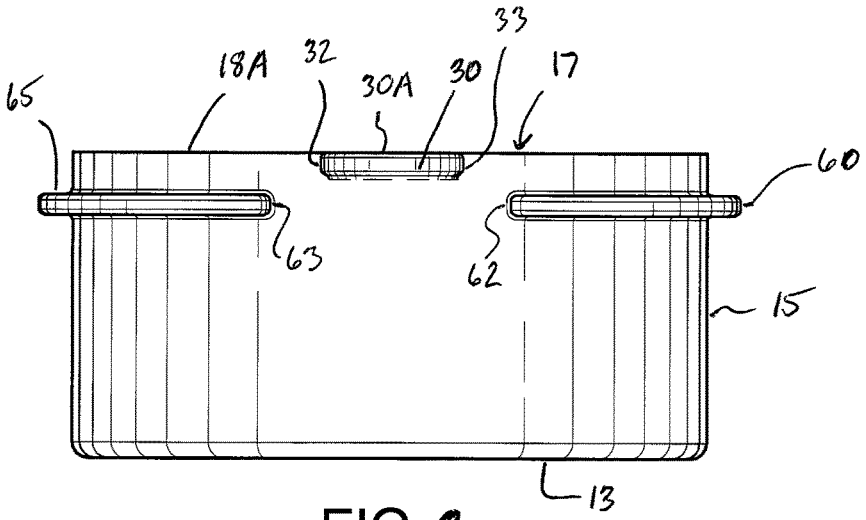
FIG. 9 is an elevational view of the lower tank portion of FIG. 5 from one side thereof.
Figure 10:
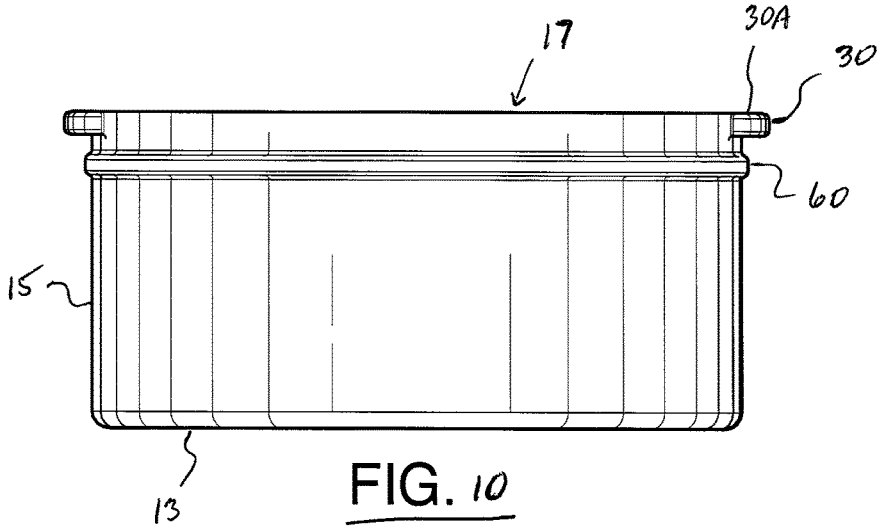
FIG. 10 is an elevational view of the lower tank portion of FIG. 5 from another side 90 degrees from that in FIG. 9.
Figure 11:
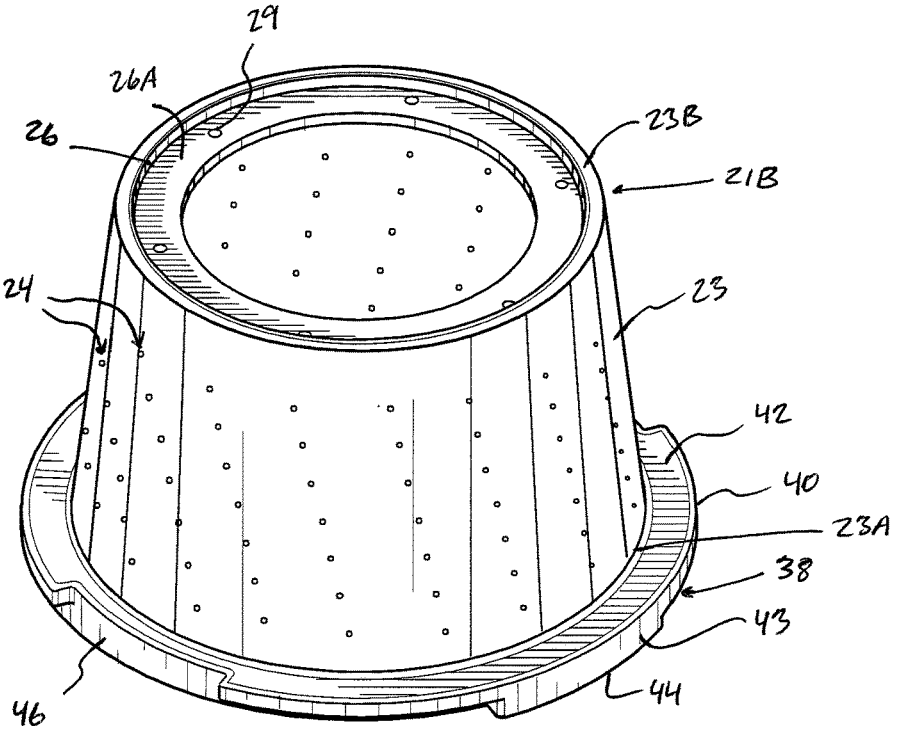
FIG. 11 is a perspective view of upper tank portion of the collection tank of FIG. 1 from the top thereof.
Figure 12:
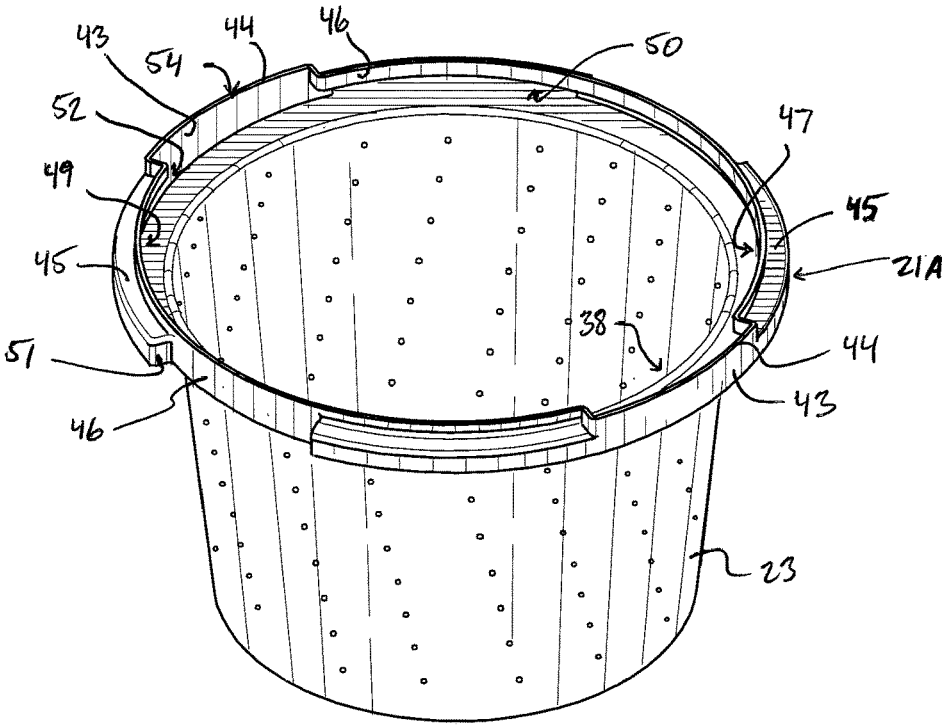
FIG. 12 is a perspective view of the upper tank portion of FIG. 11 from the bottom.
Figure 13:
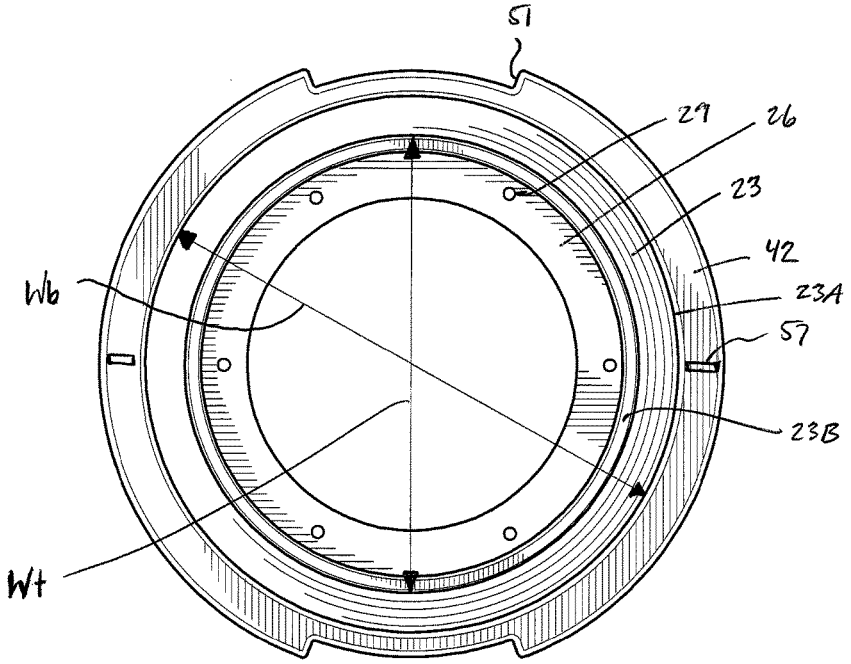
FIG. 13 is a top plan view of the upper tank portion of FIG. 11.
Figure 14:
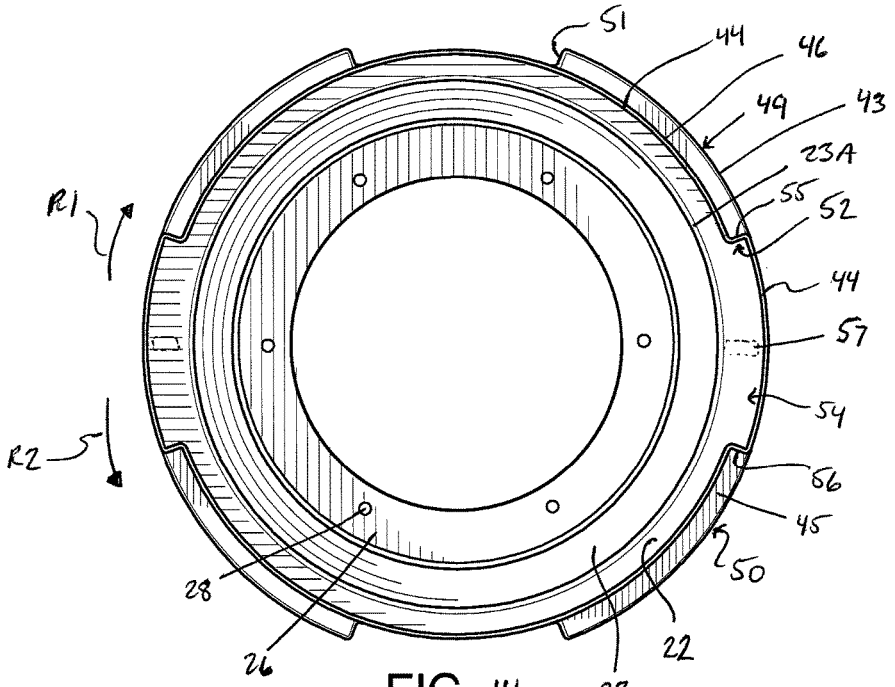
FIG. 14 is a bottom plan view of the upper tank portion of FIG. 11.
Figure 19:
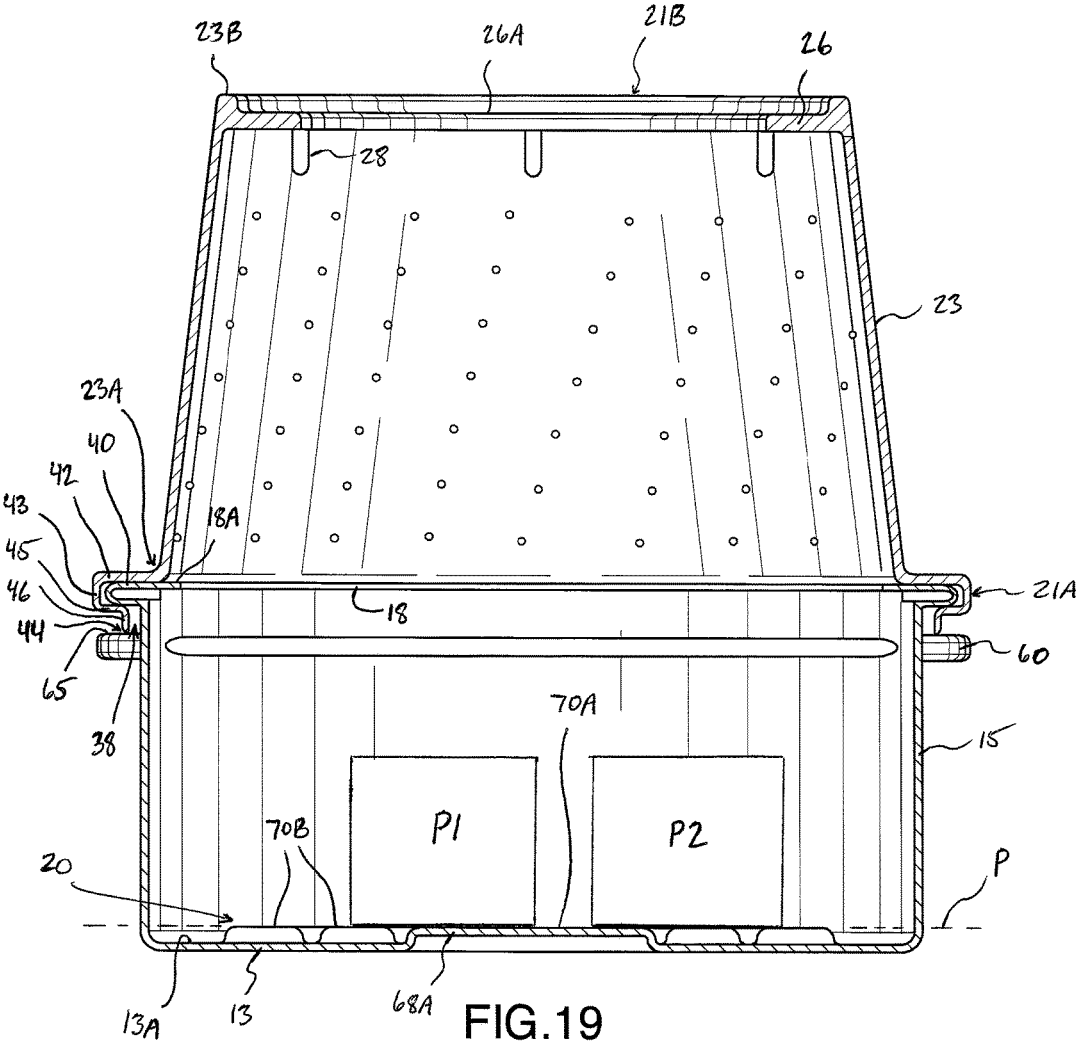
FIG. 19 is a cross-sectional view of the collection tank of FIG. 1 taken along line 19-19 in FIG. 18.

As shown in FIGS. 7 and 19, the top surfaces 70A and 70B of the ridges 68A and 68B are spaced inwardly from the outer wall 15 of the lower tank portion.

The upper and lower tank portions can be manufactured by extrusion moulding from suitable plastics material.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A collection tank for mounting under a floor of a building for collecting water from an area under the floor and for receiving a pump for transferring the water from inside the collection tank to a location externally thereof, the collection tank comprising:

a lower tank portion defining a base of the collection tank having a bottom wall for resting on a support surface and an outer wall upstanding from the bottom wall to define an open top of the lower tank portion;

the lower tank portion being adapted to support the pump on the bottom wall within an interior of the lower tank portion where the water is receivable;

an upper tank portion for standing upwardly from the open top of the lower tank portion in a working position of the collection tank, the upper tank portion having an outer wall extending upwardly from a bottom to a top of the upper tank portion;

the upper tank portion including at least one opening such that the water can flow into the collection tank;

the lower tank portion including a tab which is supported externally of the lower tank portion on the outer wall of the lower tank portion and which projects outwardly from said outer wall;

the upper tank portion defining a cavity in communication with an outside of the upper tank portion;

the cavity extending in a circumferential direction of the upper tank portion and having opposite upper and lower walls which are interconnected in vertically spaced relation; and the cavity being arranged to receive the tab between the upper and lower walls upon rotation of the upper tank portion relative to the lower tank portion around a tank axis encompassed by the outer walls of the upper and lower tank portions so as to locate the tab between the upper and lower walls of the cavity, such that the upper tank portion is removably secured to the lower tank portion against lifting movement generally parallel to the tank axis when in the working position.

2. The collection tank according to claim 1 wherein the lower tank portion defines a ledge surface spaced below the tab such that a bottom edge of the upper tank portion is in contact with the ledge surface in the working position.

3. The collection tank according to claim 1 wherein the cavity of the upper tank portion extends in the circumferential direction of the upper tank portion from a closed end to a throat which opens at the bottom of the upper tank portion such that the upper tank portion is positionable in the working position by alignment of the throat and tab angularly of the tank axis.

4. The collection tank according to claim 1 wherein the cavity comprises a pair of neck portions terminating at closed ends that are spaced apart circumferentially of the upper tank portion and a throat communicating with the neck portions that is intermediate the closed ends such that the upper tank portion is rotatable in one of two opposite rotational directions for mating the tab and cavity.

5. The collection tank according to claim 1 wherein the upper tank portion tapers in width from the bottom to the top such that the upper tank portion and another upper tank portion can be nested one in the other.

6. The collection tank according to claim 1 wherein a width of the top of the upper tank portion is smaller than a width of the open top of the lower tank portion such that the upper tank portion can be received in the lower tank portion in an inverted orientation.

7. The collection tank according to claim 1 wherein the outer wall of the upper tank portion is frustoconical in shape so that the upper tank portion and another upper tank portion can be stacked in nested condition.

8. The collection tank according to claim 1 wherein the lower tank portion includes a rim defining a support surface on which a bottom surface of the upper tank portion is rested in the working position.

9. The collection tank according to claim 1 wherein the bottom wall of the lower tank portion includes a plurality of ridges raised above an inside surface of the bottom wall for supporting the pump thereon, each adjacent pair of the ridges forming therebetween a channel so that the water is collectable in the lower tank portion between the adjacent pair of the ridges.

10. A collection tank for mounting under a floor of a building for collecting water from an area under the floor and for receiving a pump for transferring the water from inside the collection tank to a location externally thereof, the collection tank comprising:

a lower tank portion defining a base of the collection tank having a bottom wall for resting on a support surface and an outer wall upstanding from the bottom wall to define an open top of the lower tank portion;

the lower tank portion being adapted to support the pump on the bottom wall within an interior of the lower tank portion where the water is receivable;

an upper tank portion having an outer wall extending upwardly from a bottom connected to the lower tank portion to a top of the upper tank portion;

the upper tank portion including at least one opening such that the water can flow into the collection tank;

the bottom wall including a plurality of ridges having top surfaces raised above an inside surface of the bottom wall to collectively define a substantially horizontal plane spaced above the inside surface of the bottom wall for supporting the pump thereon;

the top surface of each one of the ridges being spaced inwardly from the outer wall of the lower tank portion such that the water can collect therebetween; and each pair of adjacent ones of the ridges forming therebetween a channel so that the water is collectable in the lower tank portion between the respective pair of adjacent ones of the ridges.

11. The collection tank according to claim 10 wherein at least some of the ridges are arranged in an array following a shape of the periphery of the bottom wall.

12. The collection tank according to claim 10 wherein the plurality of ridges includes a central ridge and a plurality of peripheral ridges each extending parallel to a portion of a periphery of the central ridge.

13. A method of using a collection tank for mounting under a floor of a building for collecting water from an area under the floor and for receiving a pump for transferring the water from inside the collection tank to a location externally thereof, the method comprising:

providing the collection tank having:

a lower tank portion defining a base of the collection tank having a bottom wall for resting on a support surface and an outer wall upstanding from the bottom wall to define an open top of the lower tank portion;

the lower tank portion being adapted to support the pump on the bottom wall within an interior of the lower tank portion where the water is receivable;

an upper tank portion having an outer wall extending upwardly from a bottom connected to the lower tank portion to a top of the upper tank portion;

the upper tank portion including at least one opening such that the water can flow into the collection tank;

wherein the lower and upper tank portions are separable from one another;

wherein a width of the top of the upper tank portion is smaller than a width of the open top of the lower tank portion and the upper tank portion tapers in width from the bottom to the top thereof; and inserting the upper tank portion in an inverted orientation, in which the bottom of the upper tank portion is above the top thereof, into the lower tank portion so that the collection tank is inoperable for collecting the water and so as to decrease a height of the collection tank.

14. The method according to claim 13 wherein another one of the upper tank portion is nested in inverted orientation in the upper tank portion which is inserted in the lower tank portion.

15. A method of using a collection tank for mounting in a cavity under a floor of a building for collecting water from an area under the floor and for receiving a pump for transferring the water from inside the collection tank to a location externally thereof, the method comprising:

providing the collection tank comprising:

a lower tank portion defining a base of the collection tank having a bottom wall for resting on a support surface and an outer wall upstanding from the bottom wall to define an open top of the lower tank portion;

an upper tank portion for standing upwardly from the open top of the lower tank portion in a working position of the collection tank;

the upper tank portion having an outer wall extending upwardly from a bottom to a top of the upper tank portion;

the upper tank portion including at least one opening such that the water can flow into the collection tank;

wherein the lower and upper tank portions are separable from one another;

providing the pump;

lowering the lower tank portion into the cavity with the upper tank portion detached therefrom;

locating the pump within an interior of the lower tank portion; and with the lower tank portion received in the cavity, connecting the upper tank portion to the lower tank portion in the working position.

* * * * *